US009005044B2

(12) United States Patent
Checketts

(10) Patent No.: US 9,005,044 B2
(45) Date of Patent: Apr. 14, 2015

(54) AMUSEMENT RIDE

(71) Applicant: Stanley J. Checketts, Providence, UT (US)

(72) Inventor: Stanley J. Checketts, Providence, UT (US)

( * ) Notice: Subject to any disclaimer, the term of this patent is extended or adjusted under 35 U.S.C. 154(b) by 104 days.

(21) Appl. No.: 13/851,893

(22) Filed: Mar. 27, 2013

(65) Prior Publication Data

US 2013/0260906 A1 Oct. 3, 2013

Related U.S. Application Data

(60) Provisional application No. 61/616,299, filed on Mar. 27, 2012, provisional application No. 61/766,580, filed on Feb. 19, 2013.

(51) Int. Cl.

| | |
|---|---|
| ***A63G 31/00*** | (2006.01) |
| ***A63G 31/02*** | (2006.01) |
| ***A63G 31/08*** | (2006.01) |
| *A63G 7/00* | (2006.01) |

(52) U.S. Cl.

CPC ..... *A63G 31/02* (2013.01); *A63G 31/08* (2013.01)

(58) Field of Classification Search

CPC ..... A63G 21/00; A63G 21/04; B61B 13/00; B61B 13/10; B61B 13/12; B61B 13/122; B61B 13/127

USPC ..... 472/2, 49, 50, 130, 131, 134; 104/53, 104/138.1, 138.2

See application file for complete search history.

(56) References Cited

U.S. PATENT DOCUMENTS

| | | | | |
|---|---|---|---|---|
| 4,487,410 | A * | 12/1984 | Sassak | 472/131 |
| 5,193,462 | A | 3/1993 | Marcu | |
| 5,769,724 | A | 6/1998 | Wiegel | |
| 6,319,140 | B1 | 11/2001 | Mirfin et al. | |
| 6,397,755 | B1 | 6/2002 | Kamler | |
| 6,875,115 | B2 * | 4/2005 | Fea | 472/43 |
| 7,025,656 | B2 * | 4/2006 | Bailey | 446/444 |

FOREIGN PATENT DOCUMENTS

WO 2007011398 A2 1/2007

OTHER PUBLICATIONS

PCT/US2013/034174 International Search Report and Written Opinion mailed Jul. 14, 2013.

* cited by examiner

*Primary Examiner* — Kien Nguyen
(74) *Attorney, Agent, or Firm* — Kunzler Law Group, PC

(57) ABSTRACT

Described herein is an amusement ride that includes an object that supports a passenger, a carriage that releasably supports the object, a propulsion mechanism that accelerates the carriage and the object releasably supported by the carriage up to a desired velocity, and a braking mechanism that decelerates the carriage to release the object from the carriage at the desired velocity.

19 Claims, 13 Drawing Sheets

AMUSEMENT RIDE

CROSS-REFERENCE TO RELATED APPLICATIONS

This patent application claims the benefit of U.S. Provisional Patent Application No. 61/616,299, filed Mar. 27, 2012, and U.S. Provisional Patent Application No. 61/766,580, filed Feb. 19, 2013, which are incorporated herein by reference.

FIELD

This patent application is in the field of theme park rides for amusement, entertainment and diversion, and more specifically relates to thrill rides for providing passengers with sensations of sudden acceleration, weightlessness and/or falling.

BACKGROUND

Some conventional amusement rides provide entertainment to passengers by offering sudden acceleration and/or free-fall sensations. However, many such amusement rides suffer from several shortcomings.

Certain conventional amusement rides employ rapid acceleration techniques to give passengers the sensation of sudden acceleration techniques. Some rapid acceleration techniques include electromagnetic propulsion systems that accelerate a passenger without the aid of gravity. Other rapid acceleration techniques include employ resiliently flexible chords to accelerate a passenger without the aid of gravity. Regardless of the type of acceleration technique, conventional techniques can be complex and unreliable.

Various amusement rides offering free-fall sensations conventionally tether the passenger to an object that is fixed relative to the ground. For example, some amusement rides include a passenger car movably coupled to a non-vertical track, such as a rollercoaster, while other amusement rides include passenger cars movably coupled to a vertical track, such as a drop tower. Other amusement rides, such as bungee swings, launch a passenger coupled to a resiliently flexible chord. Although these conventional amusement rides may provide a passenger with free-fall sensations, in each case, during upward or downward motion, the passenger remains tethered, such as via a track or chord, to an object fixed to the ground.

SUMMARY

The subject matter of the present application has been developed in response to the present state of the art, and in particular, in response to the problems and needs of amusement rides that have not yet been fully solved by currently available rides. Accordingly, the subject matter of the present application has been developed to provide an amusement ride that overcomes at least some of the above-discussed shortcomings of prior art amusement rides.

According to one embodiment, an amusement ride includes a capsule that is configured to contain and secure at least one passenger. The amusement ride also includes a launch system that has an upper end at a first height above a reference surface. The launch system is configured to launch the capsule containing the passenger in an arc-shaped path extending to a second height greater than the first height. The amusement ride also includes a capture system that has a receiving end at a third height less than the second height. The capture system is configured to flexibly capture the capsule.

The capsule experiences untethered free motion while traveling the arc-shaped path from the upper end of the launch system to the receiving end of the capture system.

In some implementations of the amusement ride, a launch angle between a launch portion of the arc-shaped path and horizontal is greater than about eighty degrees. According to some implementations, the second height can be greater than about one and a half times the first height. The launch system can be selected from the group consisting of a combustion-based launch system, a pneumatic-based launch system, a hydraulic-based launch system, and a magnetic propulsion-based launch system.

According to certain implementations, the launch system includes a launch tube that has a longitudinal axis, and a shot cart that is translatable along the longitudinal axis of the launch tube for releasably supporting the capsule during launch. The launch tube can include an open end and a closed end. The launch system may further include a compressed air delivery system that is configured to pressurize a space within the launch tube between the shot cart and the closed end. Pressurized air within the space drives the shot cart and capsule along the longitudinal axis of the launch tube. The launch system can additionally include a braking mechanism that is configured to decelerate the shot cart to release the capsule from the shot cart.

According to some implementations of the amusement ride, the capture system includes at least one of a web member made from a flexible material, a plurality of cable-based support systems mechanically coupled to a plurality of damper mechanisms, or a plurality of bendable support pylons. In certain implementations, the capture system includes the web member for capturing the capsule made from a stretchable material, the plurality of cable-based support systems for supporting the web member and being mechanically coupled to the plurality of damper mechanisms, and the plurality of bendable support pylons for supporting the plurality of cable-based support systems.

In another embodiment, a method for moving amusement ride passengers through an arc-shaped path above a reference surface with untethered free motion includes loading at least one passenger within a capsule. The capsule is configured to contain and secure the passenger while traveling along the arc-shaped path. The method also includes loading the capsule containing the passenger into a lower end of a launch system having an upper end at a first height above the reference surface. Further, the method includes launching the capsule containing the passenger into the arc-shaped path and towards a receiving end of a capture system. The arc-shaped path extends to a second height above the reference surface greater than the first height. The capsule experiences untethered free motion while traveling the arc-shaped path from the upper end of the launch system towards the receiving end of the capture system. Additionally, the method includes capturing the capsule containing the passenger at the receiving end of the capture system.

According to certain implementations, the method includes launching the capsule at a launch angle greater than about eighty degrees where the launch angle being measured between a launch portion of the arc-shaped path and horizontal. The receiving end of the capture system can be located at a third height above the reference surface where the third height is less than the second height. The method can also include removing the capsule containing the passenger from the receiving structure and unloading the passenger from the capsule.

In yet another embodiment, an amusement ride includes a launch structure with a rail pathway within a tube. The tube includes a closed first end and an open second end. The amusement ride also includes a carriage that includes a component that pushes a passenger car along the rail pathway in the launch structure. Additionally, the amusement ride includes a pneumatic propulsion mechanism that pressurizes the tube between the first closed end of the tube and the carriage to propel the carriage and passenger car along the rail pathway.

According to some implementations of this amusement ride, the passenger car is releasably coupled to the carriage, and the amusement ride further includes a braking system that is configured to decelerate the carriage to release the passenger car from the carriage. The rail pathway within the tube can extend in a substantially horizontal direction. Accordingly, the pneumatic propulsion mechanism can propel the carriage and passenger car along the rail pathway in the substantially horizontal direction.

In another embodiment, an amusement ride includes an object that supports a passenger, a carriage that releasably supports the object, a propulsion mechanism that accelerates the carriage and the object releasably supported by the carriage up to a desired velocity, and a braking mechanism that decelerates the carriage to release the object from the carriage at the desired velocity. In some implementations, the object is an untethered capsule and the propulsion mechanism accelerates the carriage and the object in a substantially upwardly direction, where the object is released from the carriage at the desired velocity in the substantially upwardly direction. According to certain implementations, the object is a rollercoaster car movably coupled to a rail and the propulsion mechanism accelerates the carriage and the rollercoaster car in a substantially horizontal direction, where the rollercoaster car is released from the carriage at the desired velocity in the substantially horizontal direction. In yet some implementations, the amusement ride includes an elongate tube within which the object and carriage are accelerated and the elongate tube includes a closed end and open end, where the propulsion mechanism includes a pressurized air delivery system configured to pressurize a space within the elongate tube between the carriage and the closed end.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter of the present disclosure will be readily understood, a more particular description of the subject matter will be rendered by reference to specific embodiments that are illustrated in the appended drawings. Understanding that these drawings depict only typical embodiments of the subject matter of the present disclosure and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Illustrated in FIGS. 1-15 are several representative embodiments of an amusement ride for providing untethered free motion, which embodiments also include one or more methods of accelerating amusement ride passengers and moving the passengers through an arc-shaped, substantially vertical path above a reference surface with tether-free motion. Additionally, FIGS. 16-22 are several representative embodiments of an amusement ride that shares some aspects of the embodiments of FIGS. 1-15 to provide acceleration of amusement ride passengers and moving passengers through a substantially horizontal path with tethered motion. As described herein, the amusement ride provides several significant advantages and benefits over other amusement rides and methods for providing passengers with sensations of sudden acceleration, weightlessness, and/or falling. However, the recited advantages are not meant to be limiting in any way, as one skilled in the art will appreciate that other advantages may also be realized upon practicing the present disclosure.

Figure 1:
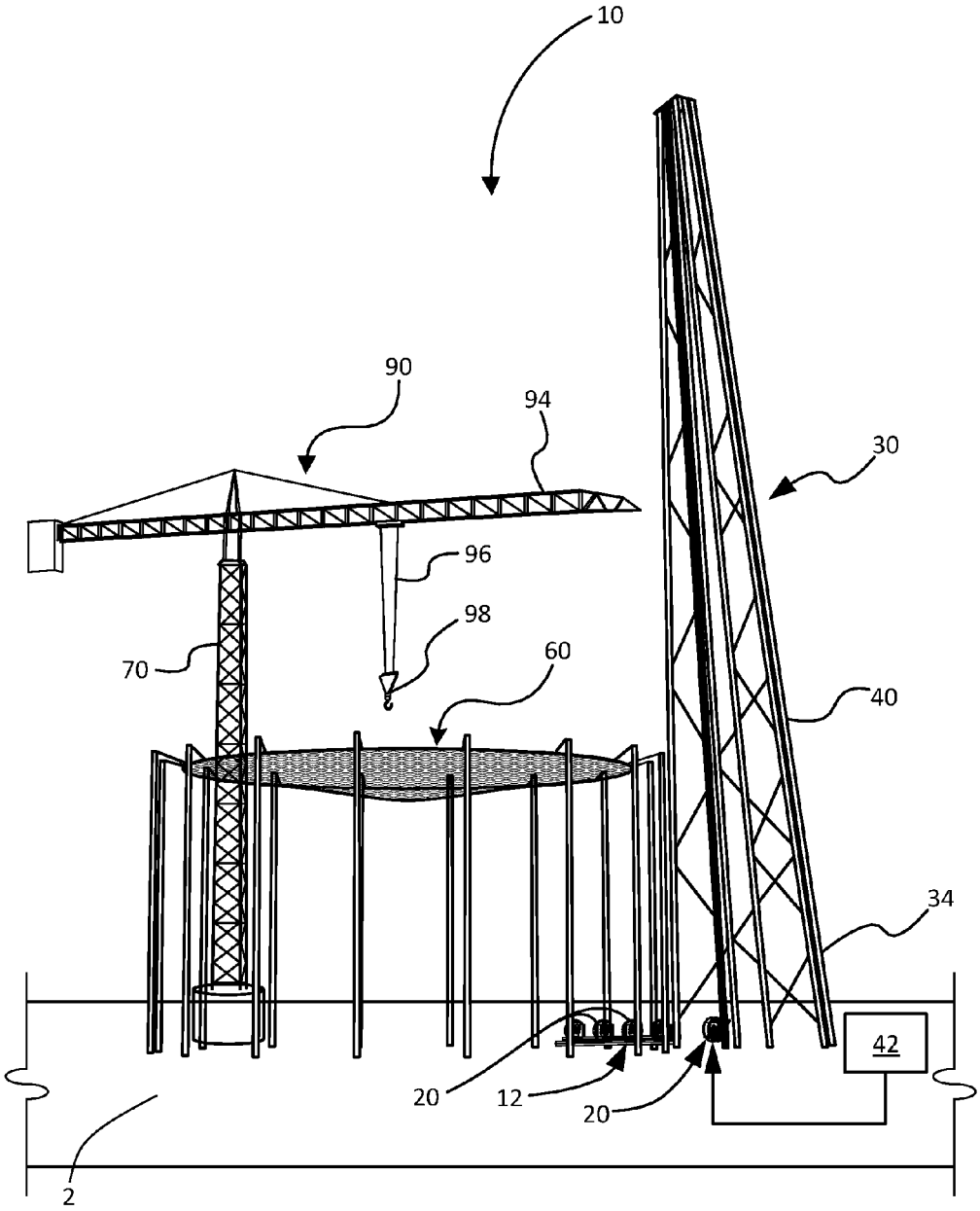
FIG. 1 is a perspective side view of an amusement ride in accordance with an embodiment of the present disclosure.
Figure 2:
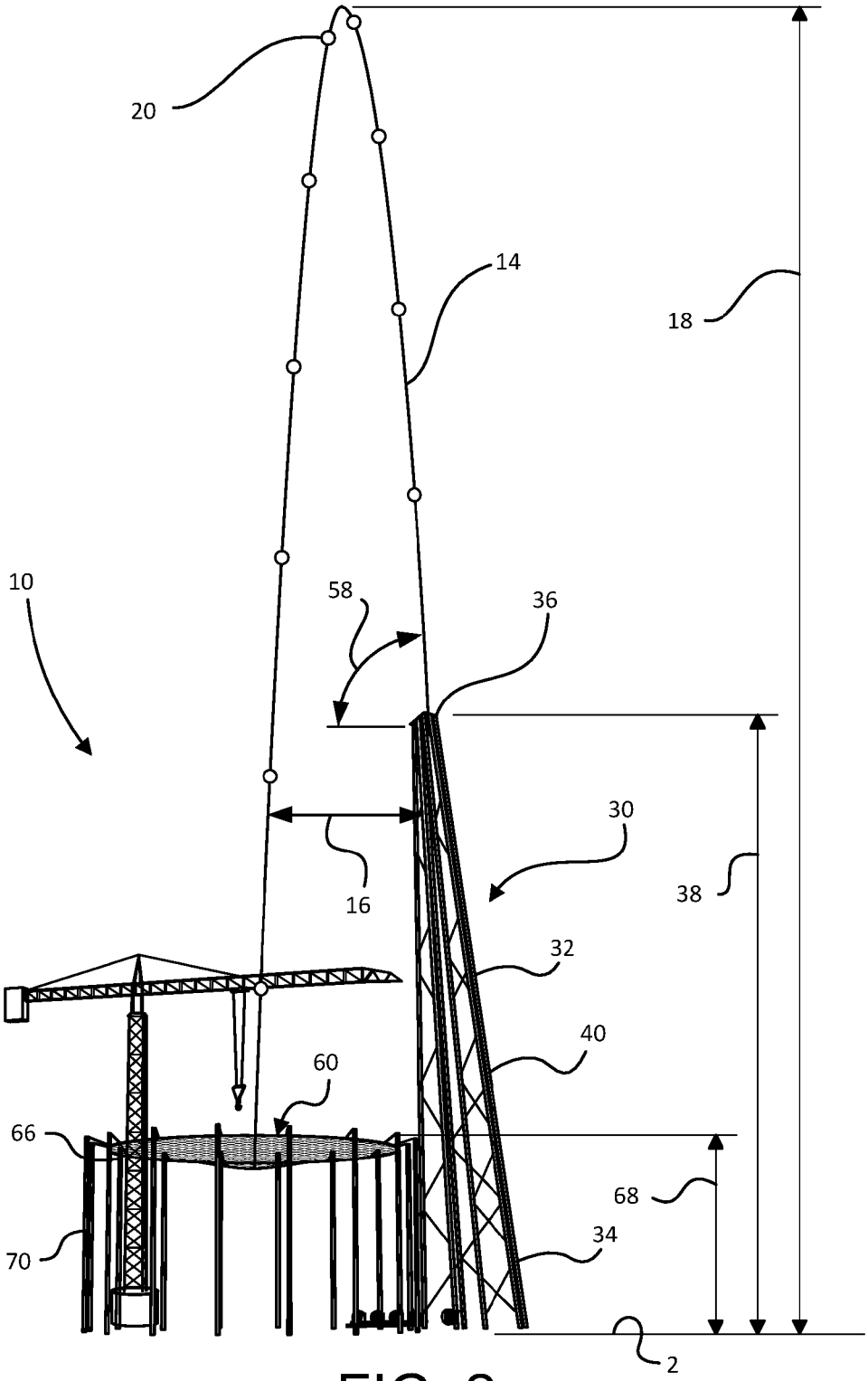
FIG. 2 is a broad perspective side view of the amusement ride of FIG. 1.

FIGS. 1 and 2 show an exemplary embodiment of an amusement ride 10 for providing untethered free motion to one or more passengers riding thereon. The illustrated amusement ride 10 is built above a reference surface 2, such as the ground surface shown in the figures. However, in other implementations, the reference surface 2 could also be the surface of a body of water, such as a lake, a river, or an ocean. In addition, in other embodiments, all or a portion of the ride 10 can be positioned below the reference surface 2.

The ride 10 includes a capsule 20 for containing and securing passengers therein. The ride 10 also includes a launch system 30 that has a launch structure 40. The launch system 30 is configured to launch the capsule 20 containing the passengers into a high-angle, arc-shaped path extending above an upper end of the launch system (see, e.g., FIG. 3). The ride further includes a capture or deceleration system 60 that has a receiving structure 70. The deceleration system 60 is configured to safely capture the capsule 20 as it falls back towards the reference surface 2 under the influence of gravity.

As shown in FIG. 2, upon being launched by the launch system 30 the capsule 20 follows along an arc-shaped path 14 from the upper end 36 of the launch system 30 to the receiving end 66 of the capture system 60. Moreover, the capsule 20 remains untethered with reference to the launch and receiving structures or to any ground reference, and is subject only to the force of gravity as it follows the arc-shaped path 14. Thus, the capsule 20 experiences free motion as it travels a substantially-ballistic trajectory through the ascending, apogee, and descending portions of the arc-shaped path 14. This substantially-ballistic trajectory provides the passengers riding therein with the thrilling sensations of weightlessness and falling.

The arc-shaped path 14 has a high-angle trajectory because a launch angle 58 between a launch portion of the arc-shaped path (as provided by the launch system 30) and the horizontal reference surface 2 is greater than eighty degrees. In the illustrated embodiment of the amusement ride 10 shown in FIGS. 1 and 2, the launch angle 58 can be closer to perpendicular with the reference surface, such as about eighty-seven degrees. Having a high launch angle 58 can significantly limit the horizontal or lateral distance 16 traveled by the capsule to a small proportion of the vertical height 18 traveled by the capsule as it follows the arc-shaped path 14, which in turn provides several advantages to the amusement ride 10. For instance, the high launch angle 58 can reduce the size of the capture system 60 needed to safely retrieve the capsule 20, while at the same time enhancing the thrilling sensations of vertical acceleration, extreme height, weightlessness, and falling provided to the passengers within the capsule 20. The high launch angle 58 of eighty degrees or more can also expand the range of capsule launch velocities that can be accommodated by the capture system 60.

The launch system 30 of the amusement ride 10 includes the launch structure 40 having an upper end 36 at a first height 38 above the reference surface 2. Generally, the launch structure 40 (e.g. a launch tower) is the first height 38 at which the capsule 20 is launched. After being launched from the launch system 30, the capsule 20 then travels the arc-shaped path 14 to a maximum second height 18 above the reference surface 2. Depending on the launch angle 58 and the velocity of the capsule 20 as it is released from the launch system 30, the second height 18 can be at least 1.5 times the first height 38 of the launch structure 40. In some cases the second height 18 can be at least two times the first height 38 of the launch structure 40. In yet some cases, if desired, the second maximum height 18 can be less than 1.5 times the first height 38 of the launch structure 40.

The capture system 60 includes the receiving structure 70 having a receiving end 66 positioned at a third height 68 relative to the reference surface 2. In the embodiment of the amusement ride 10 shown in FIGS. 1 and 2, the third height 68 is less than the first height 38 of the launch structure 40. While this arrangement may be useful for many applications of the amusement ride described herein, it is to be appreciated that the receiving end 66 of the receiving structure 70 can also be positioned in a variety of different configurations relative to both the reference surface 2 and the upper end 36 of the launch structure 40. For instance, in other embodiments of the amusement ride the receiving end 66 may be located at or below the level of a reference ground surface (e.g. with a portion of the receiving structure 70 also being located below the reference ground surface) so as to extend the downward portion of the arc-shaped path or to create the thrilling effect of coming into closer proximity with the ground before being captured. Alternatively, the receiving end 66 of the receiving structure 70 may be located at a height above the first height 38 of the launch structure 40, which can create an upward stair-stepping effect.

Figure 3:
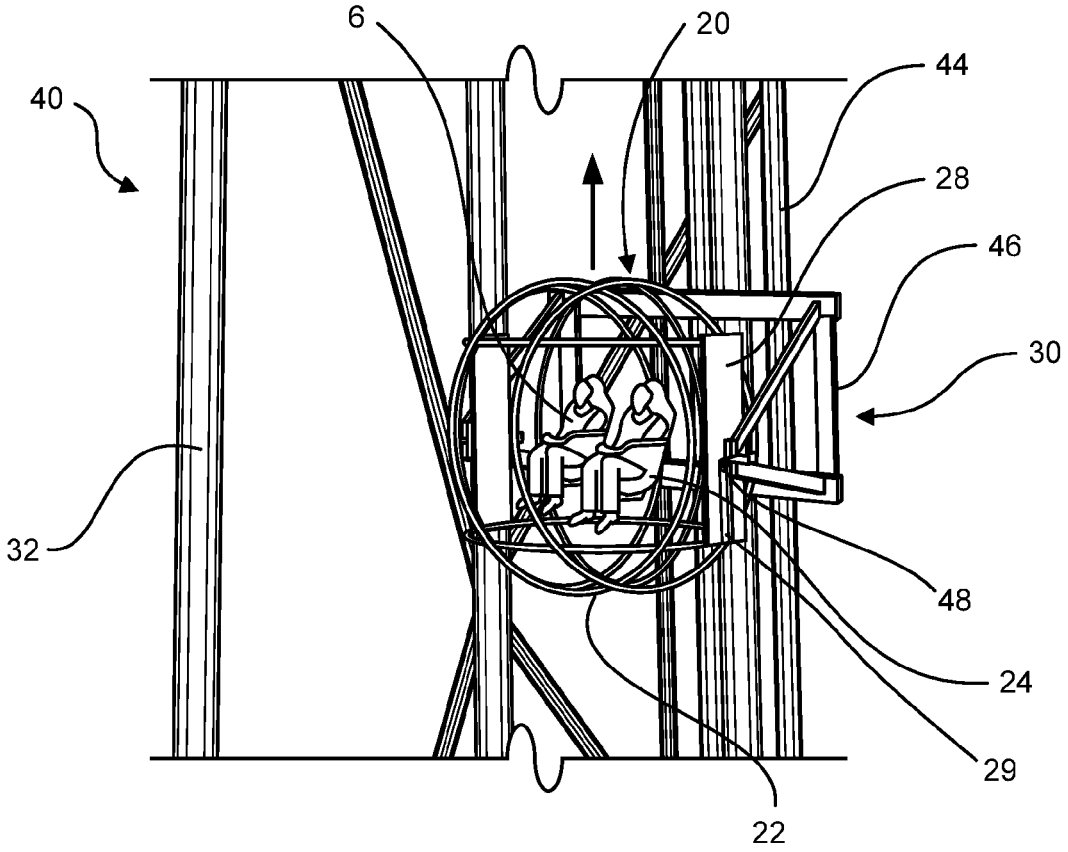
FIG. 3 is a close-up perspective side view of a capsule being launched from the launch structure in accordance with the embodiment of FIG. 1.
Figure 4:
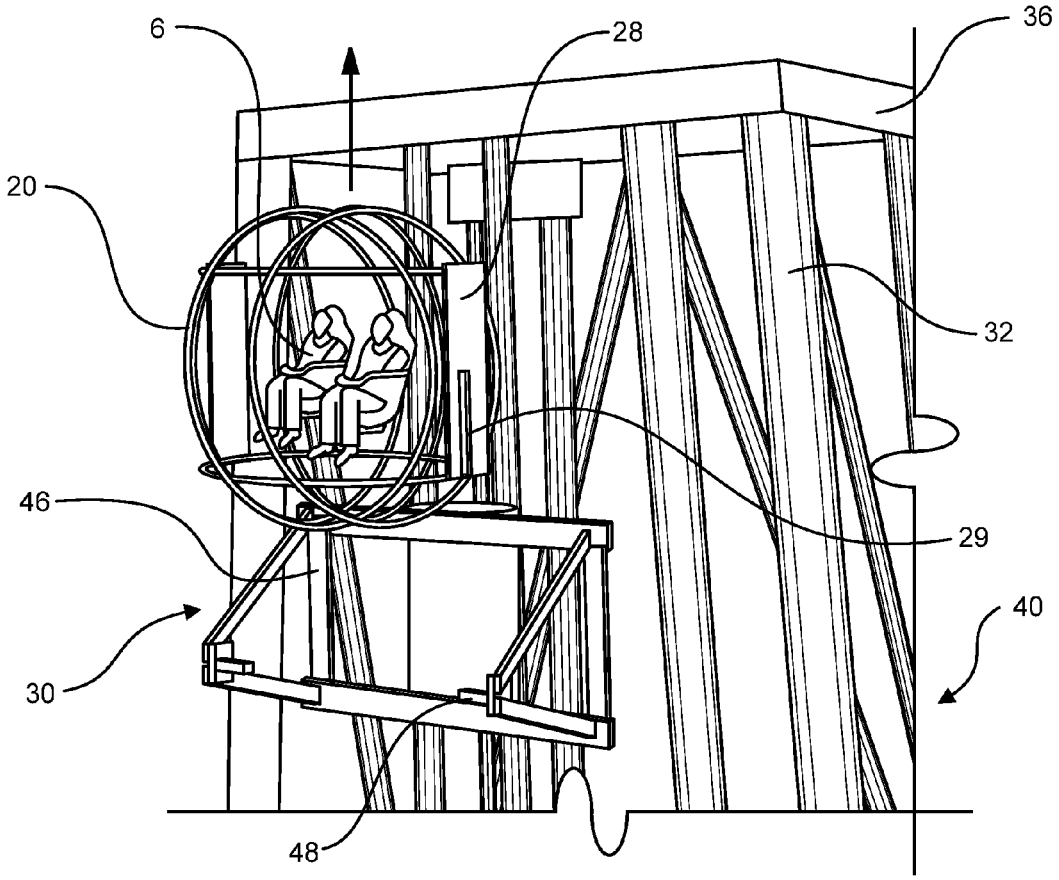
FIG. 4 is another close-up perspective side view of the capsule launched from the launch structure in accordance with the embodiment of FIG. 1.

Referring to FIGS. 3 and 4, the launch system 30 also includes a tower or framework 32 having a base 34 proximate the reference surface 2 and the upper end 36 at the first height above the reference surface 2, as described above. The tower 32 supports other portions of the launch system 30, such as one or more upwardly-directed rails 44 which guide the capsule 20 along the tower 32 during launching. The launch system 30 also includes a propulsion mechanism 42 (see, e.g., FIG. 1), which provides sufficient power to accelerate the capsule 20 up the launch rails 44 to the velocity necessary to carry the capsule upward beyond the upper end 36 of the launch structure 40 and into the ascending portion of the arc-shaped path 14. The propulsion mechanism can be any of various types of propulsion mechanisms, or formed from any of various types, including, but not limited to, a pneumatic-based propulsion mechanism, a hydraulic-based propulsion mechanism, a magnetic-based propulsion mechanism, and a combustion-based propulsion mechanism, etc.

The propulsion mechanism 42 may be coupled to the capsule 20 during launch using a variety of different devices and techniques. For example, as shown in FIG. 3, the launch system 30 of the illustrated amusement ride 10 includes a carriage 46 which provides the mechanical coupling between the capsule 20, the launch rails 44, and the propulsion mechanism 42 during launch. Passengers 6 can be secured within the capsule 20 in a capsule staging area or loading zone 12. In turn, the capsule 20 with secured passengers 6 is loaded into the launch system 30 at the base 34 of the launch tower 32 by releasably coupling the capsule 20 with the carriage 46.

Referring again to FIG. 3, in the illustrated embodiment, the releasable coupling between the capsule 20 and carriage 46 can be provided by a channeled bracket connector 28 on the carriage 20, which has a channel 29 that slidably mounts around a post connector 48 extending inwardly from the carriage supports. The channeled bracket connector 28 can include a downwardly-facing contact surface (not shown) which rests on the upper half of the post connector 48. In this configuration, the force of gravity can be used to maintain the connection between the capsule 20 to the carriage 46, both when the capsule and carriage are at rest and during their mutual acceleration up the launch tower 32.

During launching the propulsion mechanism is activated to accelerate the carriage 46 and the coupled capsule 20 up the launch rails 44 to a desired launch velocity. Once the launch velocity is reached, the launch system 30 will then provide rapid braking of the carriage 46 via a deceleration system as it approaches the upper end 36 of the launch structure 40, as shown in FIG. 4. Because the carriage 46 is rapidly decelerated and the capsule 20 is releasably coupled to the carriage, the momentum of the capsule allows the bracket connector 28 to slide upward off the post connector 48 and thereby release the capsule 20 from the launch system 30. It is understood that other types of interconnections between the capsule 20 and the carriage 46 are possible, as is also the form of mechanical linkage between the capsule and the launch system 30 itself, each of which may be considered to fall within the scope of the present disclosure.

The deceleration system for the carriage located near the upper end 36 of the launch structure 40 can be any of various types of braking mechanisms, or formed from any of various types known to one of skill in the art. These can include, but are not limited to, a friction-based braking mechanism, a pneumatic-based braking mechanism, and an eddy-current magnetic braking mechanism, etc.

Also shown in FIGS. 3 and 4 is the construction of the capsule 20, which can include seating 24 supported within an outer cage 22. The passengers 6 can be secured to the seating 24 with appropriate safety restraints (e.g. straps, harnesses, etc.), which hold the passengers in position for the duration of the ride. Although most of the impact of landing can be absorbed by the flexible capture system, as described below, the connection between the seating 24 and the outer cage 22 may also be provided with some shock absorbance and compliance. Furthermore, in some implementations the outer cage may also be equipped with an emergency air bag system (not shown), which could be automatically activated in the event that the capsule is thrown or blown outside a target landing area of the capture system.

Figure 5:
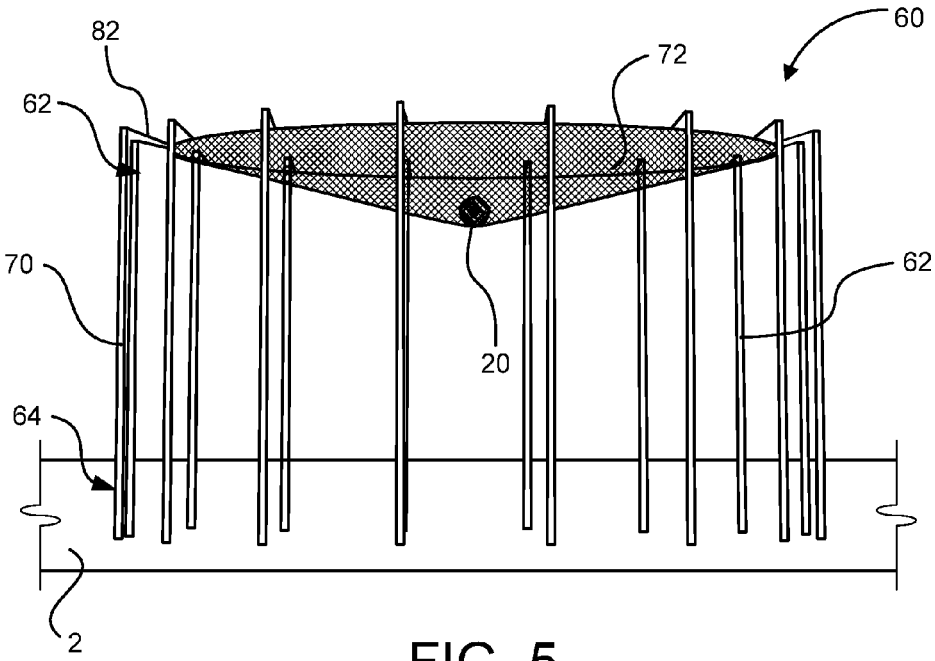
FIG. 5 is a close-up perspective side view of the capsule being initially captured by a receiving structure in accordance with the embodiment of FIG. 1.
Figure 6:
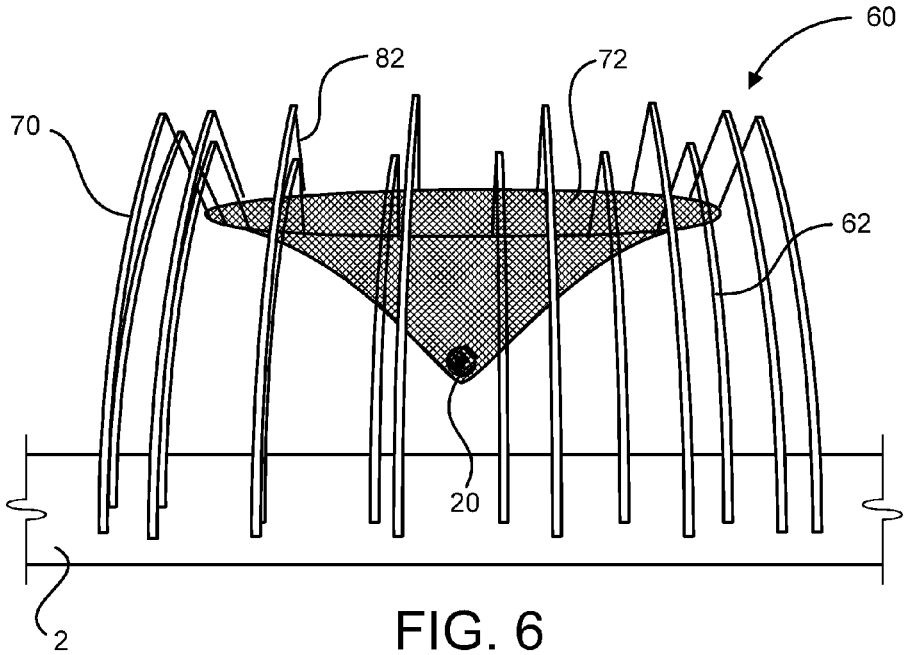
FIG. 6 is another close-up perspective side view of the capsule following initial capture by the receiving structure in accordance with the embodiment of FIG. 1.

The structure and operation of the representative capture system 60 for the embodiment of the amusement ride 10 are shown in FIGS. 5 and 6. The capture system 60 includes a receiving structure 70 formed from a plurality of support pylons 62. Each support pylon 62 has a base end 64 proximate the reference surface 2 and a receiving end 66 at approximately a third height above the reference surface 2.

The capture system 60 receives the capsule 20 as it completes its substantially-ballistic arc-shaped path and returns to earth under the influence of gravity. The capture system 60 is configured to flexibly capture and control the landing of the capsule 20 in such a way as to minimize the forces of deceleration on the passengers contained within the capsule. For instance, the capture system 60 can include a net or web member 72 which is strung between the plurality of support pylons 62 to form a target landing area. For circular implementations, the web member 72 can be up to 200 feet or more in diameter. Alternatively, the web member 72 can be less than 200 feet in diameter.

The web member 72 can have a substantially uniform structure throughout, or may have a variable structure to better accommodate the expected impact forces in the target landing area. For instance, in one aspect the web member 72 can be formed from a plurality of crisscrossing straps, with the straps in the center section being wider (e.g. 4 inches in width) and the straps around the periphery being narrower (e.g. 2 inches in width). In some implementations the straps can made from nylon or similar material having a low modulus of elasticity.

As shown in FIG. 5, the capsule 20 can land in a depression formed by the weight of the web member 72 bowing under gravity. Upon contact with the moving capsule 20, the web member 72 can flex or stretch in the downward direction as it partially slows the capsule. However, a substantial portion of the deceleration of the capsule 20 is effectuated by the lengthening of the cables 82 which attach the web member 72 to the pylons 62 and the bending of pylons themselves, as illustrated in FIG. 6. In addition to the combined spring constant provided by the various components supporting the capture system 60, the capture system can also incorporate one or more damping and/or backing mechanisms which absorb and control the energy received into the capture system 60 from rapidly-decelerating capsule 20. This can result in a fully-damped capture system 60 which allows each of the web member 72, the cables 82, and the support pylons 62 to return to their approximately original positions without rebound.

Figure 7:
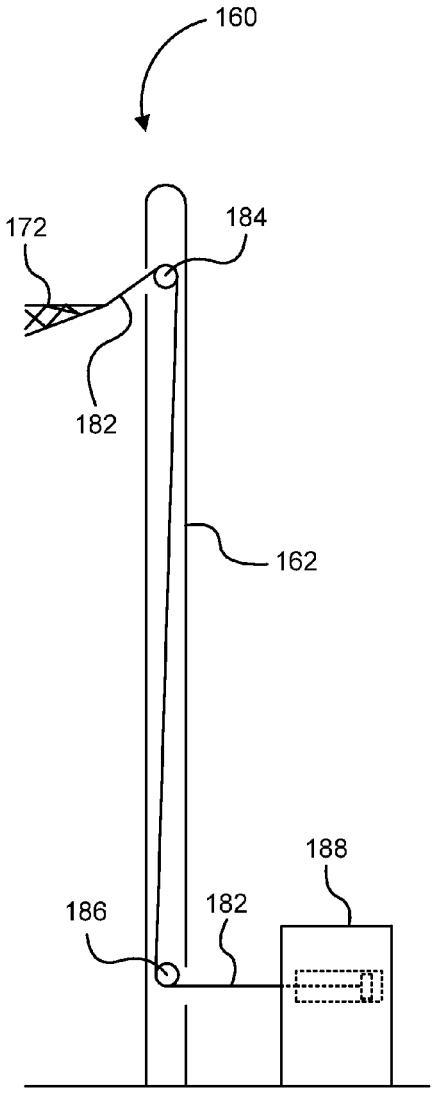
FIGS. 7 and 8 are schematic cross-sectional diagrams illustrating a capture system in accordance with another embodiment of the present disclosure.
Figure 8:
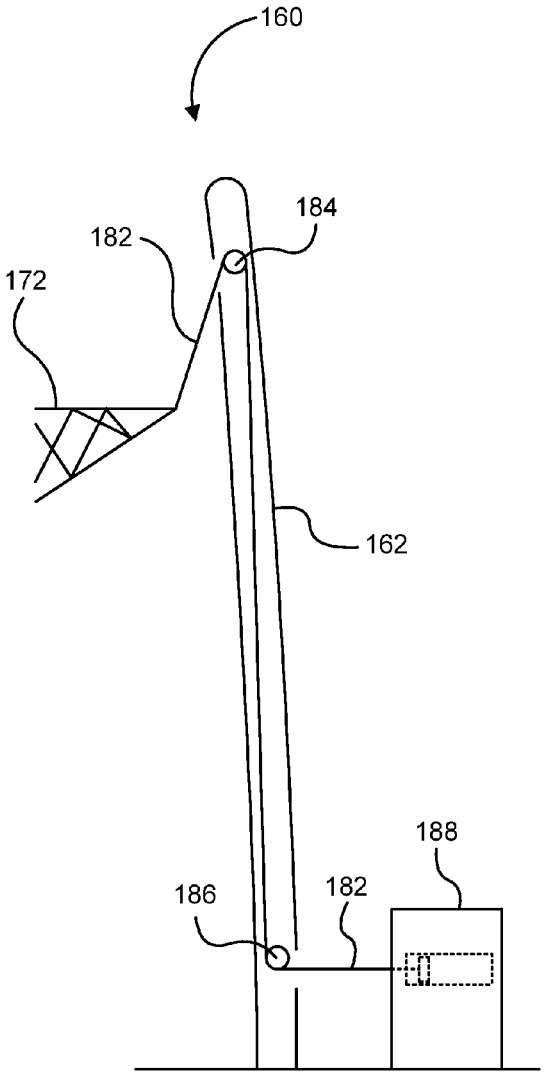

Another exemplary embodiment of the capture system 160 is shown with more detail in FIGS. 7 and 8. The capture system 160 can include the web member 172 that is supported with cables 182 which extend to support pylons 162. The cables 182 wrap over an upper pulley 184 located near the top of the support pylons, travel downward to a lower pulley 186 located near the bottom of the support pylon, and then enter a brake/damper mechanism 188 located proximate the base of the support pylon. Although the cable 182 is drawn as passing through the inside of a hollow support pylon in the figures, it is to be appreciated that other configurations are equally possible. For example, the support pylon 162 can be substantially solid with the cable 182 being directed around the outside of the support pylon. Alternatively, the cable 182 can be strung over a single pulley 184 near the top of the support pylon to a brake/damper mechanism 188 located further away from the receiving structure, etc.

As with the propulsion mechanism described above, the brake/damper mechanism 188 can be formed from a variety of different types, including but not limited to a pneumatic-based brake/damper mechanism, a hydraulic-based brake/ damper mechanism, and a magnetic-based brake/damper mechanism, etc. The brake/damper mechanism 188 can be passively or actively controlled to provide the capture system 160 with its fully-damped characteristics. For example, in one implementation the brake/damper mechanism 188 can be a magnetic speed control system that utilizes a plurality of non-ferrous, rotating braking fins which can rotate within non-rotating magnetic braking calipers to generate an opposing magnetic field to provide a braking force to the capture system 160, as described in co-pending U.S. Patent Application Publication No. 2011/0313607, which was published on Dec. 22, 2011 and entitled "Speed Control System", which application is incorporated by reference in its entirety herein.

It is to be appreciated, moreover, that the various structural components of the capture system 160, such as the web member 172, the cables 182, and the support pylons 186, etc., can each be individually configured to be more or less compliant to provide the capture system with an optimal combined spring constant which compliments the brake/damper mechanism 188 to provide critical damping to the capture system 160.

Although a few specific embodiments of the capture system are shown and described above, it is recognized that any of various other capture or deceleration systems can be employed. For example, the amusement ride of the present disclosure can use capture or deceleration systems either known or not now known in the art, such as systems that utilize one or more of flexible poles, cables and weights, magnetic clutch devices, and the like.

Referring back to FIG. 1, after the capsule 20 has landed and become sufficiently stationary, the capsule retrieval system 90 can be activated to return the capsule to the capsule staging area/loading zone located near the base of the launch structure 40. In the illustrated embodiment, the capsule retrieval system 90 operates to swing an arm 94 over the web member and lower a hook 98 on a cable 96 to retrieve the capsule 20 from the receiving structure 60. The capsule retrieval system 90 then swings back to both return the capsule 20 to the capsule staging area/loading zone 12 and to uncover the receiving structure 70 in preparation for the launching of the next capsule.

Figure 9:
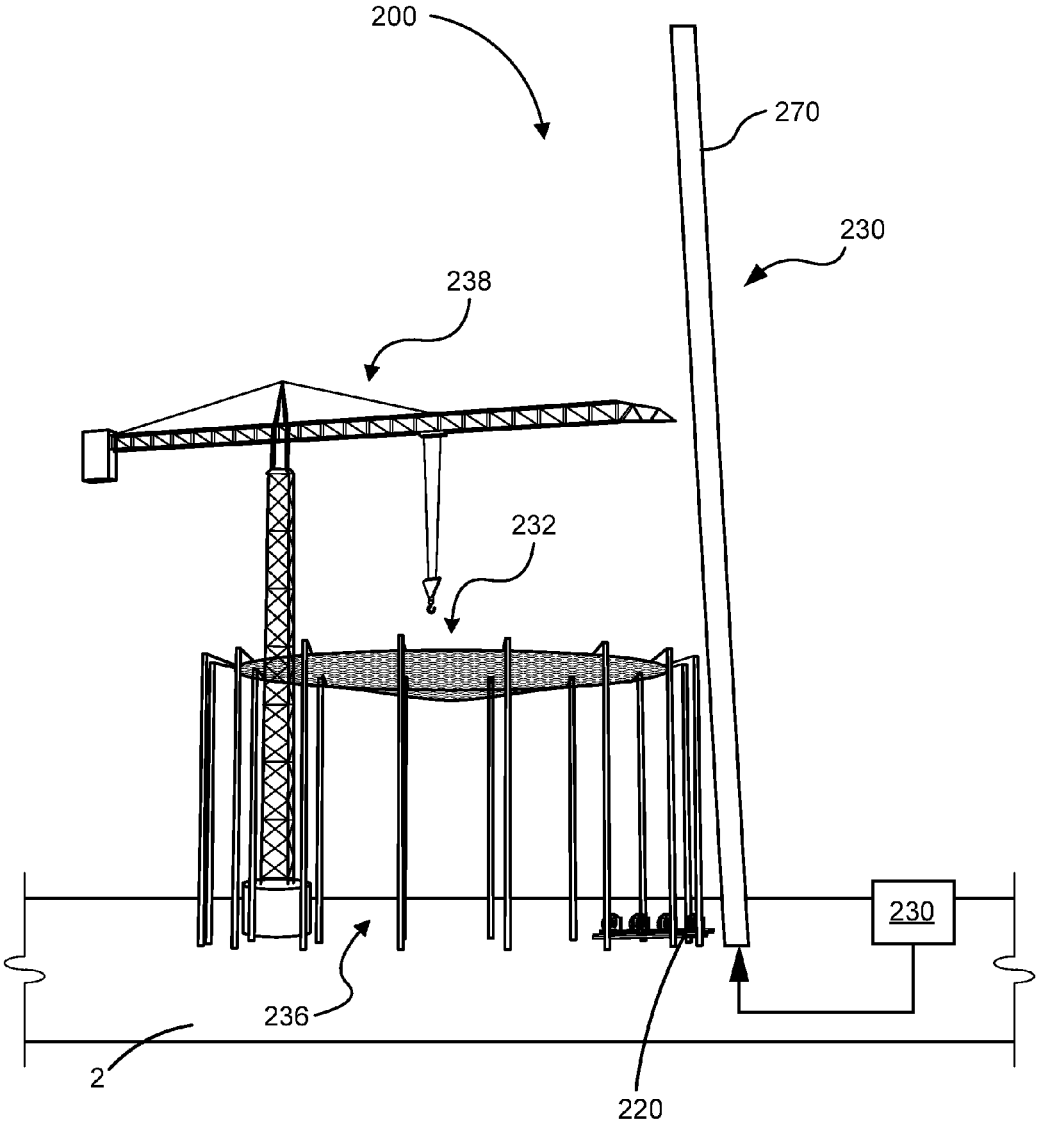
FIG. 9 is a perspective side view of an amusement ride in accordance with another embodiment of the present disclosure.

Another embodiment of the amusement ride 200 for providing untethered free motion to one or more passengers is shown in FIG. 9. The amusement ride 200 includes a capsule 220 for containing and securing the passengers therein. The amusement ride 200 also includes a launch system 230 configured to launch the capsule 220 containing the passengers into an high-angle arc-shaped path which extends above the upper end of the launch system. The amusement ride 200 further includes a capture system 232 configured to safely capture the capsule 220 as it falls back towards the reference surface 2 under the influence of gravity. The amusement ride 200 also includes a capsule retrieval system 238 for returning the capsule 220 from the capture system to the staging area.

Instead of the open rail-type launch system described above, the amusement ride 200 incorporates an enclosed tube-type launch system 230 that combines a launch tube 270 with a low-pressure pneumatic-based launch mechanism 230 to launch the capsule 220 into the arc-shaped path. Similar to the embodiment of the launch system 30 described with reference to FIG. 1, the launch tube 270 can launch the capsule 220 at a high launch angle of about eighty-seven degrees. Also shown in FIG. 9 is an optional emergency cushion 236 located below the capture system 232 which can absorb any remaining impact energy if the capture system fails to completely arrest the motion of the capsule 220 during landing.

Figure 10:
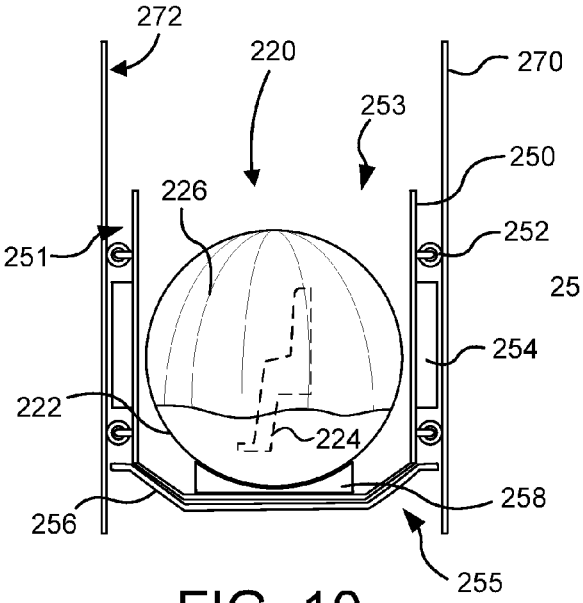
FIG. 10 is a schematic side view of a capsule and launch system of an amusement ride, such as the amusement ride associated with the embodiment of FIG. 9.
Figure 11:
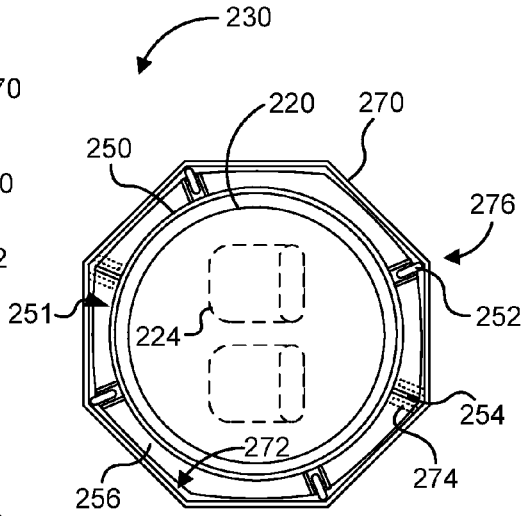
FIG. 11 is a schematic top view of the capsule and launch system of FIG. 10.

Referring now to FIGS. 10 and 11, the launch system 230 further includes a carriage or shot cart 250 installed within the launch tube 270. The shot cart 250 can have an open cylinder arrangement with cylindrical sidewalls 251, an open top 253 and a closed bottom 255. The shot cart 250 can also include a cradle 258 or similar structure located within the cart and near the closed bottom 255 for centering and supporting the capsule 220 during launching. The cylindrical sidewalls 251 can project up beyond the height of the capsule 220 and can include multiple sets of wheels or rollers 252 which extend laterally from the sidewalls 251 to fit into corresponding recess formed into the launch tube 270. If the launch tube has an octagonal or similar polygonal cross-section, as shown in FIG. 11, the rollers 252 on the shot cart 250 can engage the inside surfaces 272 of the recesses 276 formed by the obtuse corners of the launch tube 270.

The shot cart 250 can also include a packing blanket 256 or other type of sealing member attached below the closed bottom 255 of the vehicle for creating at least a partial seal against the inside surfaces 272 of the launch tube 270 during operation of the low-pressure pneumatic launch system 200, as described below. The packing blanket may not be required to seal tightly against the inside surfaces 272, but can allow for a clearance (e.g. a gap of one inch or more) around the edges, with greater allowable clearance near the obtuse corner recesses 276 of the octagonal launch tube 270, if necessary. It is considered that the large surface area provided by the closed bottom end 255 of the shot cart in combination with a pressure differential of 2-4 PSIG will generate a force sufficient to push the shot cart 250 and installed capsule 220 up the launch tube 270 which a high rate of acceleration, even with the loosely-fitting seal around the edges of the packing blanket 256. Other configurations for the packing blanket are also possible, such as annular rings extending from the sidewalls 251 of the shot cart towards the inside surfaces 274 of the launch tube 270.

The shot cart 250 can also include one or more brake fins 254 which form the moving members of a magnetic brake system. The brake fins 254 can be made from a ferrous metal such as iron or alloys thereof, and are configured to interface with one or more pairs of magnetic calipers 274 located at the top of the launch tube 270 (see FIGS. 10 and 11) to form an eddy-current magnetic braking system for the shot cart 250. The magnetic calipers 274 can be made from a permanent magnetic material which causes a magnetically-induced force to be generated between the shot car 250 and the launch tower 270 which opposes the motion of the shot cart. Thus, the shot cart can be quickly stopped at the end of the launching sequence while allowing the momentum of the capsule 220 to carry the capsule upward and out of the top opening of the launch tube. Other types of braking systems for the shot cart, such as a friction-based braking system, are also possible.

Also shown in FIG. 10 is an optional shroud 226 placed over the upper portion of the capsule 220 to prevent the passengers secured to the seating 224 from extending an object or a hand outside of the cage 222 of the capsule during launch.

Figure 12:
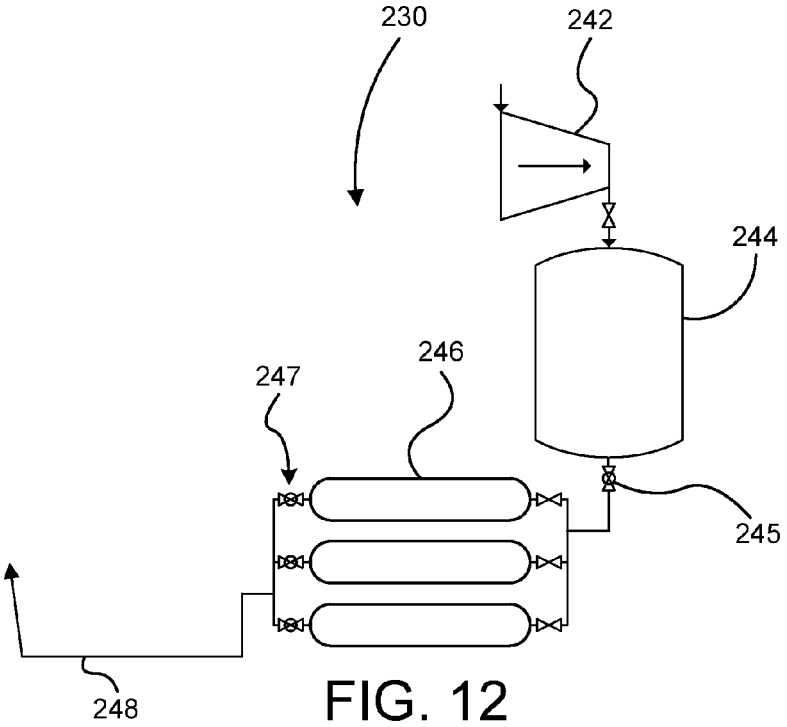
FIG. 12 is a schematic view of a launch system for an amusement ride, such as the amusement ride associated with the embodiment of FIG. 9.

Referring now to FIG. 12, the launch system 230 is low-pressure pneumatic-based launch system that includes an air compressor 242 supplying pressurized air to an air tank 244. The air tank 244 can serve as bulk storage for compressed air over a wide range of pressures. The air tank 244 in turn feeds pressurized air through a control valve 245 to a plurality of shot tanks 246 which serve as the source of compressed air to the launch tube 270. Having multiple shot tanks can provide a degree of redundancy to the launch system 230 to ensure that the capsule will always have sufficient velocity to clear the launch tube 270 and travel to the capture system, even if, for example, one shot tank 246 were to fail or one of the rapid-release shot valves 247 were to operate improperly. The shot valves 247 can be fast-opening control valves configured to quickly release the compressed air in the shot tanks into the base of the launch tube 270 through inlet pipe 248.

Figure 13:
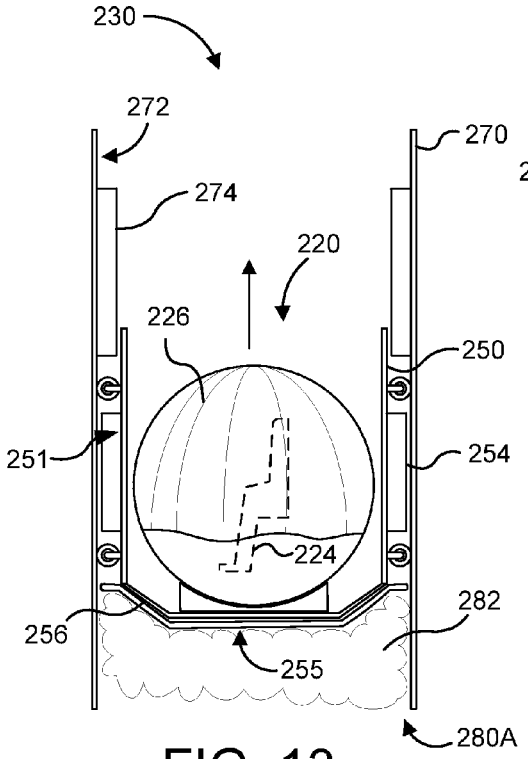
FIG. 13 is a side view illustrating the capsule and launch system of FIG. 10 during operation but prior to releasing the capsule according to one embodiment.

As depicted in FIG. 13, once the compressed air 282 is released into the variable volume 280A extending from base of the launch tube 270 to the closed bottom 255 of the shot cart 250, the increased pressure acting on the bottom end of the shot cart 250 will immediately begin to push the cart upwards. The shot cart 250 and the capsule 220 can together weigh about 2,000 lbs. when loaded with the passengers. However, because the packing blanket 256 can have an effective surface area of about 7,000 square inches or more, the pneumatic-based launch system may only be required to provide the compressed air 282 at pressure ranging from about 2 to about 4 PSIG to accelerate the shot cart 250 and capsule 220 up the launch tube 270. In other implementations the pressure can be more or less than the range specified above, depending upon the configuration and dimensions of the launch tube 270 and shot cart 250.

Accordingly, the pneumatic capacities and dynamic responses of the shot tanks 246, control valves 247 and inlet pipe 248 (FIG. 12) can be configured to continuously provide an amount of compressed air at a desired pressure to the base of the launch tube 270 that will maintain the compressed air 282 within the rapidly-expanding volume 280B (FIG. 14) below the shot cart 250 at a substantially constant pressure. If desired, bleed ports (not shown) can be incorporated into the walls of the launch tube 270 to release some of the pressure as the shot cart 250 moves toward the upper end of the launch tube. In one aspect the compressed air 282 within the expandable volume 280B can be maintained at sufficient pressure throughout the upward movement of the shot car 250 to accelerate both the shot cart 250 and the capsule 220 at about 4 g's to a launch speed of approximately 120 miles per hour, prior to reaching the upper end of the launch tube 270. In other aspects the launch speed of the shot cart 250 and capsule 220 can be more or less than 120 miles per hour.

Figure 14:
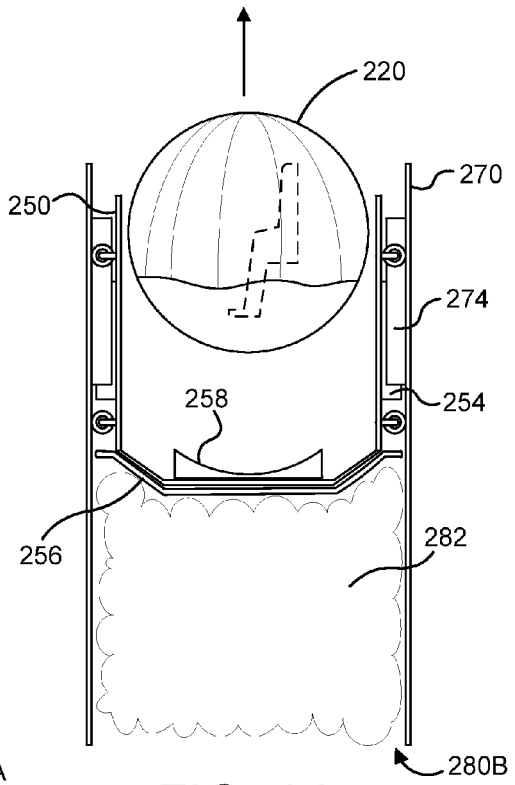
FIG. 14 is a side view illustrating the capsule and launch system of FIG. 10 during operation during operation after releasing the capsule according to one embodiment.
Figure 15:
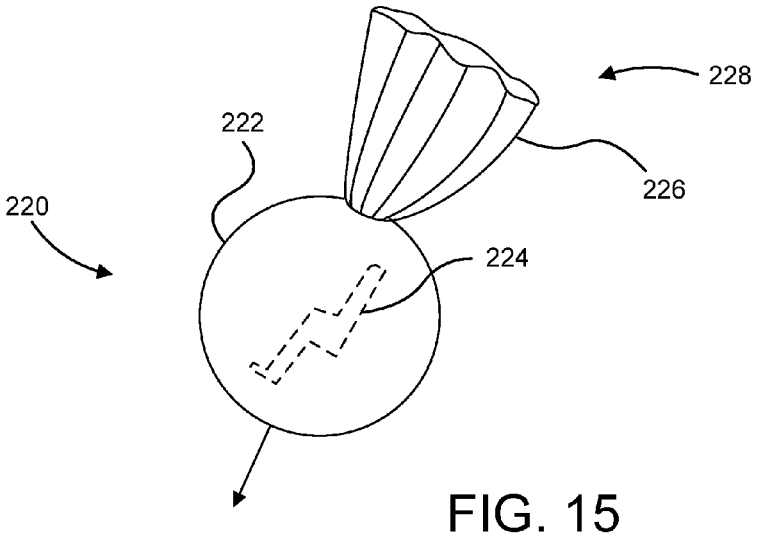
FIG. 15 is a schematic view of the capsule during a downward passage through a high-arc-shaped path ballistic trajectory in accordance with an embodiment of the present disclosure.

When the shot cart 250 reaches the upper end of the launch tube 270, as illustrated in FIG. 14, the brake fins 254 will slide within and interact with the magnetic calipers 274, without any surface-to-surface contact, to generate a powerful electromotive force directly proportional to and opposing the velocity of the shot cart. This force will rapidly decelerate the shot cart 250 to a near stop within the space of a short distance while allowing the capsule 220 to release from the cradle 258 and proceed upwards out the opening of the launch tube 270.

Once the capsule 220 is airborne and moving through the high-angle arc-shaped path with untethered free motion, as described above, the shroud 226 can release or lift away from the exterior of the capsule's cage 222 and extend rearwardly behind the capsule to create a drag element 228. The drag element 228 acts to orient the base of the cage 222 towards the capture system to position both the capsule and passengers secured within the seating 224 into an optimum shock absorbing attitude when landing in the capture system. The shroud 226 and drag element 228 are optional.

In addition, after the shot cart 250 has been stopped and the capsule 220 has been launched from the launch tube 270, a pressure release valve (not shown) in fluid communication with the base of the launch tube can open to controllably vent the compressed air 282 located within volume 280B (FIG. 15B) and allow the shot cart 250 to return to the base of the launch tube 270.

Instead of the open rail-type launch system or non-rail closed launch system described above, the amusement ride 300 incorporates an enclosed and railed tube-type launch system 230 that combines a launch tube 270 with a railed guidance system and a low-pressure pneumatic-based launch mechanism to launch an object with passengers along the rail within the tube.

Figure 16:
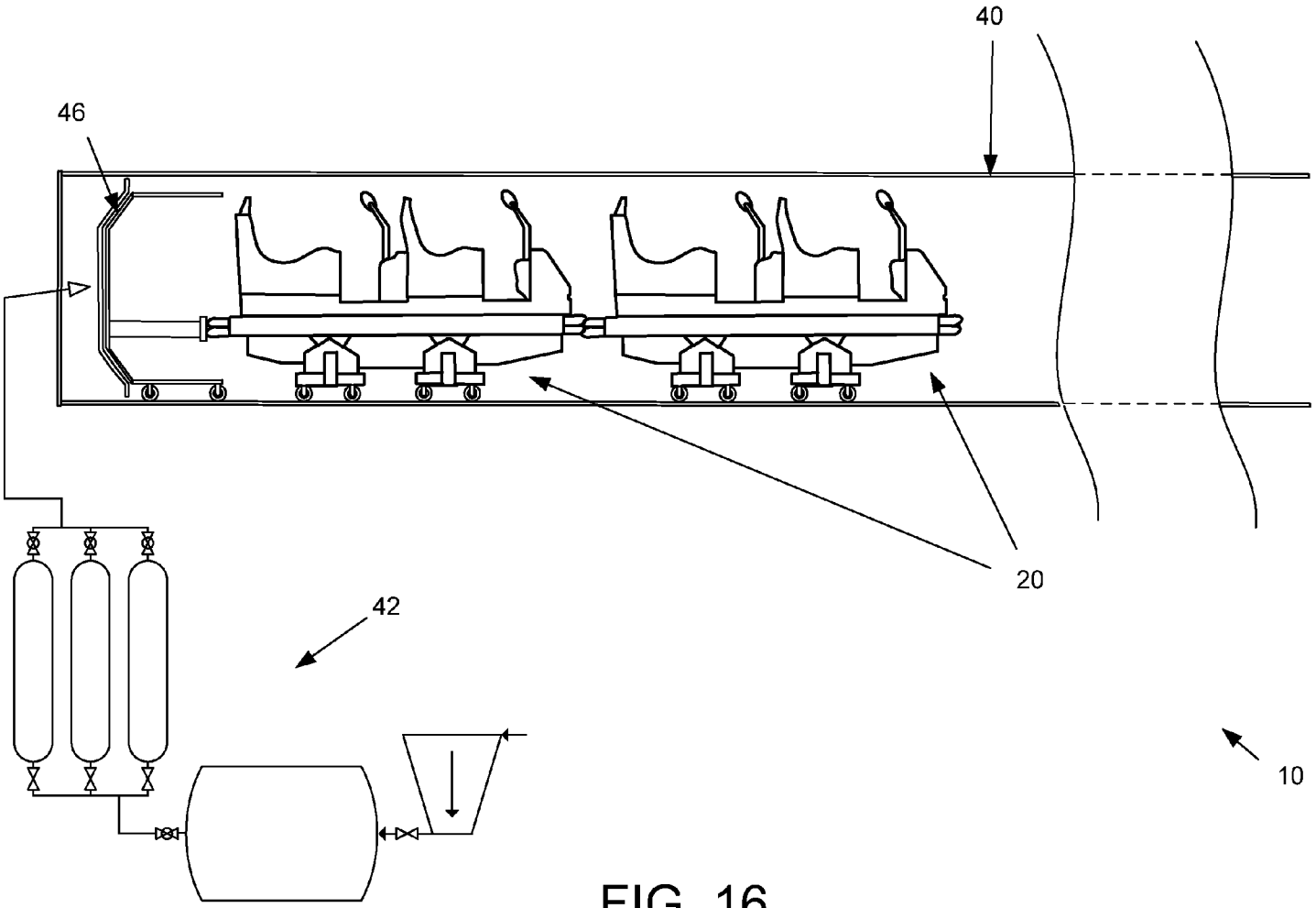
FIG. 16 is a cross-sectional side view of an amusement ride acceleration system according to one embodiment of the present disclosure.

FIG. 16 is a cross-sectional side view of an amusement ride acceleration system 310, according to one embodiment of the present disclosure. The acceleration system 310 includes a launch structure 340, a pneumatic propulsion mechanism 342, a carriage 346, and passenger cars 320. The launch structure 340 will be described below with reference to FIGS. 17-19, the carriage 346 will be described below with reference to FIGS. 20 and 21, and the pneumatic propulsion mechanism 342 will be described below with reference to FIG. 22.

The cars 320 depicted in FIG. 16 may be any type of passenger transporters which can be implemented in an amusement ride. The construction of each car 320 can include seating and appropriate safety restraints (e.g. straps, harnesses, etc.), which hold the passengers in position for the duration of the ride. Even though the singular term "car" is used throughout the disclosure, it is anticipated that the term "car" may be defined as multiple passenger transporters interconnected to form a train. Although most of the impact of acceleration can be absorbed by the passengers, the interconnections between the cars 320 may also be provided with some shock absorbance and compliance, and/or may be substantially rigid so as to prevent harmful push/pull collisions between the cars 320, which can result in damage to the cars and passenger injuries (e.g. whiplash).

Figures 17, 18, 19:
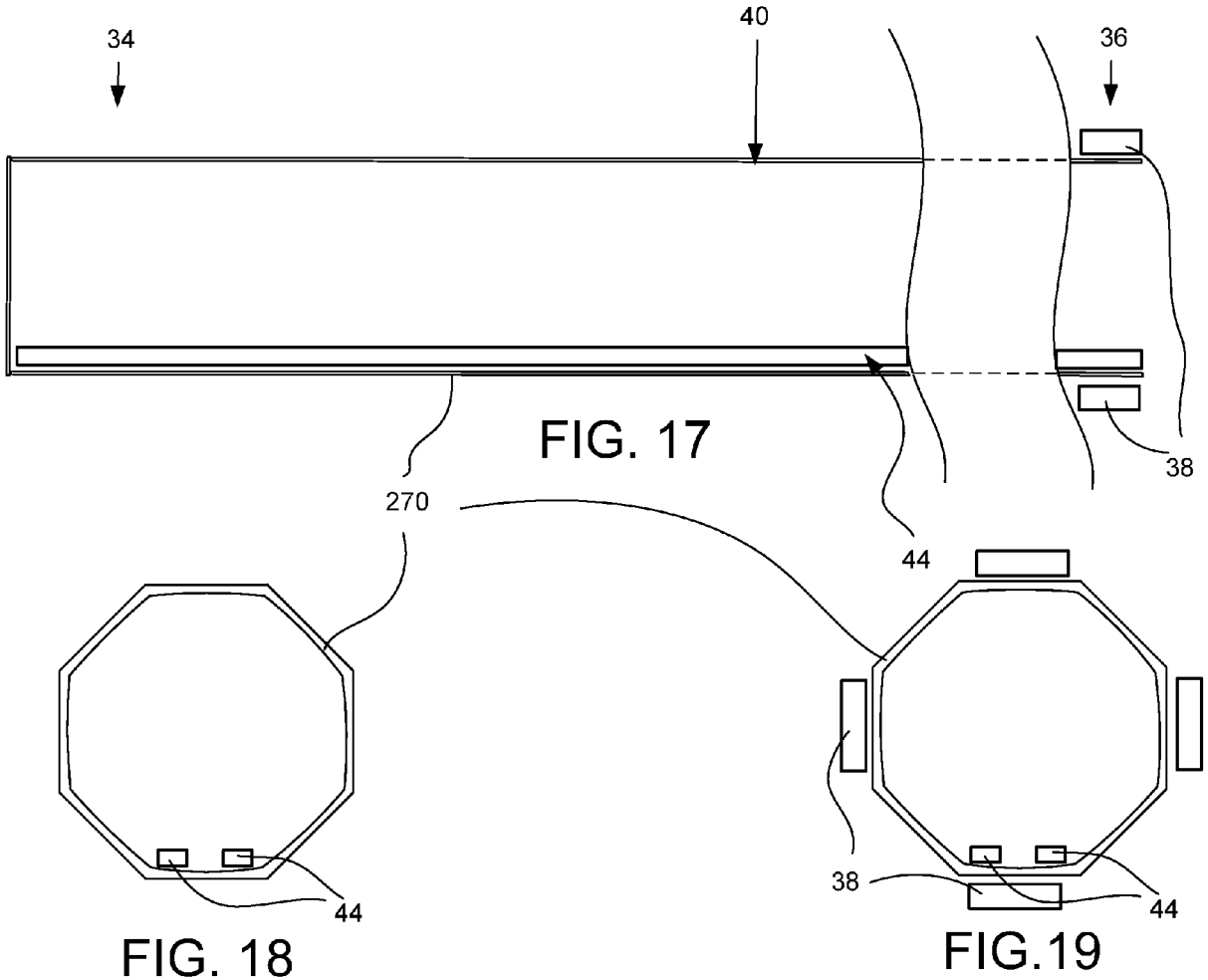
FIG. 17 is a cross-sectional side view of a launch structure according to one embodiment of the present disclosure.
FIG. 18 is a cross-sectional end view of the launch structure of FIG. 17 according to one embodiment of the present disclosure with a braking sub-system omitted.
FIG. 19 is a cross-sectional end view of the launch structure of FIG. 17 according to one embodiment of the present disclosure showing the braking sub-system.

FIG. 17 is a cross-sectional side view of a launch structure 340, FIG. 18 is a cross-sectional view as seen looking down the first end 334 of the launch structure 340, and FIG. 19 is a cross-sectional view as seen looking down the second end portion 336 of the launch structure 340, according to one embodiment of the present disclosure. The launch structure 340 may be a semi-enclosed launch tube 370 that includes a first end portion 334, a second end portion 336, rails 344 along which the cars 320 can travel, and a braking mechanism or sub-system 338. The first end portion 334 has a closed end and the second end portion 336 has an open end. The closed first end portion 334 allows the pressurized air that is introduced by the pneumatic propulsion mechanism 342 (see the description below with reference to FIG. 22) to propel the car 320 along the rails 344 and out of the open second end portion 336 of the tube 370. The rails 344 may be any type of track or pathway along which a rollercoaster car 320 may travel. The cross sectional shape of the launch tube 370 may be one of various shapes. For example, in the depicted embodiment of FIGS. 18 and 19, the launch tube 370 has an octagonal cross-section. However, it is contemplated that other cross-sectional tubes may be used, such as circular, rectangular, triangular, etc.

The braking sub-system 338 may be located near the second end portion 336 of the launch tube 370 and may include any of various types of braking mechanisms, or be formed from any of various types of braking mechanisms known to one of skill in the art. These can include, but are not limited to, a friction-based braking mechanism, a pneumatic-based braking mechanism, and an eddy-current magnetic braking mechanism, etc. The braking sub-system 338 interacts with the carriage 346, as described below with reference to FIGS. 20 and 21.

Figure 20:
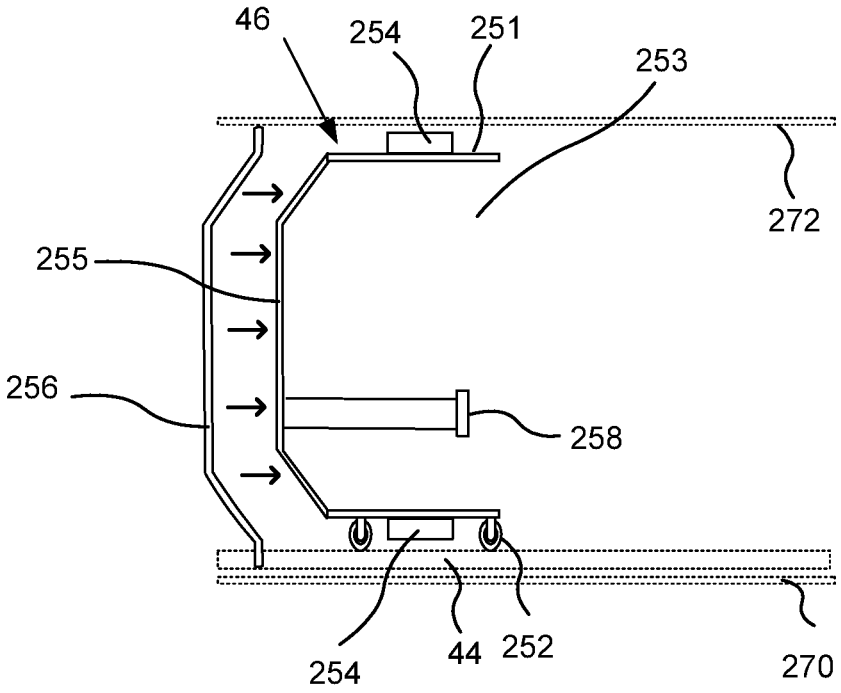
FIG. 20 is a cross-sectional side view of a carriage of a launch system according to one embodiment of the present disclosure.
Figure 21:
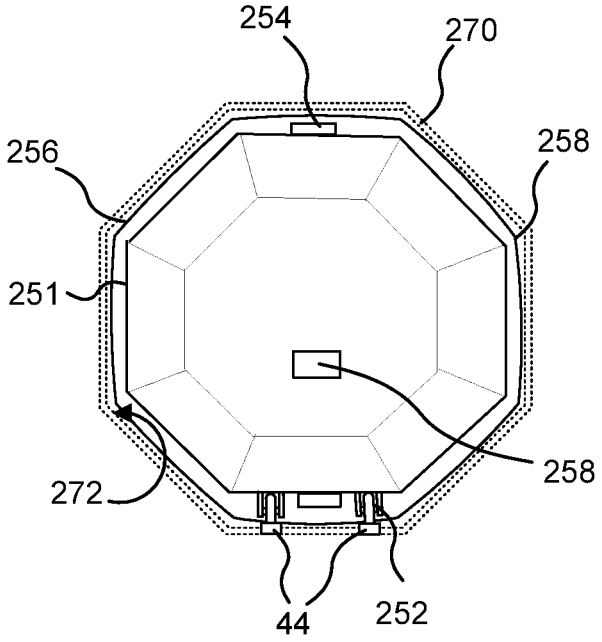
FIG. 21 is a cross-sectional end view of the carriage of FIG. 20 according to one embodiment of the present disclosure.

FIG. 20 is a cross-sectional side view of a carriage 346 and FIG. 21 is a cross-sectional view as seen from the second end portion 336 of a launch structure 340 around the carriage 346, according to one embodiment of the present disclosure. The carriage 346 may be installed within the launch tube 370. The carriage 346 can have an open cylinder arrangement with cylindrical sidewalls 351, an open front end 353, and a closed back end 355. The cylindrical sidewalls 351 can include multiple sets of wheels or rollers 352 which extend laterally from the sidewalls 351 to fit into corresponding rails 344 in the launch tube 370. The carriage 346 may also include releasable connectors or surfaces/structures 358 that engage a trailing car 320 (not depicted in FIGS. 20 and 21) during acceleration in the direction indicated by direction arrows. For example, although not shown, the structure 358 of the carriage 346 may have a cradle or similar structure attached to the closed back end 355 for matingly supporting the car 320 during acceleration. In one embodiment, the structure 258 may be configured to connect with the car 320 along the car's center of gravity. In another embodiment, multiple supporting structures 358 may be utilized to push the car 320 along the length of the tube 370 during acceleration. In such embodiments, the mechanical structure of the car 320 and/or the carriage 346 may need to be reinforced in certain areas in order to withstand the acceleration forces of the system.

According to one embodiment, the cylindrical sidewalls 351 have a shape corresponding to the cross-sectional shape of the launch structure 340. In other words, the space between the carriage 346 sidewalls 351 and the inner surface of the launch tube 370 may be small enough so that pressurized air may be used to accelerate the carriage 346 along the length of the launch tube 370. In another embodiment, the carriage 346 can also include a packing blanket 356 or other sealing member attached behind the closed back end 355 of the carriage 346 for creating at least a partial seal against the inside surfaces 372 of the launch tube 370 during operation of the low-pressure pneumatic acceleration system, as described below. The packing blanket may not be required to seal tightly against the inside surfaces 372, but can allow for a clearance (e.g. a gap of one inch or more) around the edges. It is considered that the large surface area provided by the closed back end 355 of the carriage 346 in combination with a pressure differential of 2-4 PSIG will generate a force sufficient to push the carriage 346 and installed car 320 along the launch tube 370 which a high rate of acceleration, even with the loosely-fitting seal around the edges of the packing blanket 356 or other sealing component. Other configurations for the packing blanket are also possible, such as annular rings extending from the sidewalls 351 of the carriage 346 towards the inside surfaces 372 of the launch tube 370.

The carriage 346 can also include one or more brake components 354, which interact with the braking sub-system 338 of the launch tube 370. For example, the brake components 354 may be magnetic calipers made from a permanent magnetic material which causes a magnetically-induced force to be generated between the carriage 346 (brake component 354) and the launch tube 370 (braking sub-system 338) which opposes the motion of the carriage 346. Thus, the carriage 346 can be quickly stopped at the second end 336 of the launch tube 370 while allowing the momentum of the car 320 to carry the car out of the second opening 336 of the launch tube 370. Other types of braking systems for the carriage, such as a friction-based braking system, are also possible.

Figure 22:
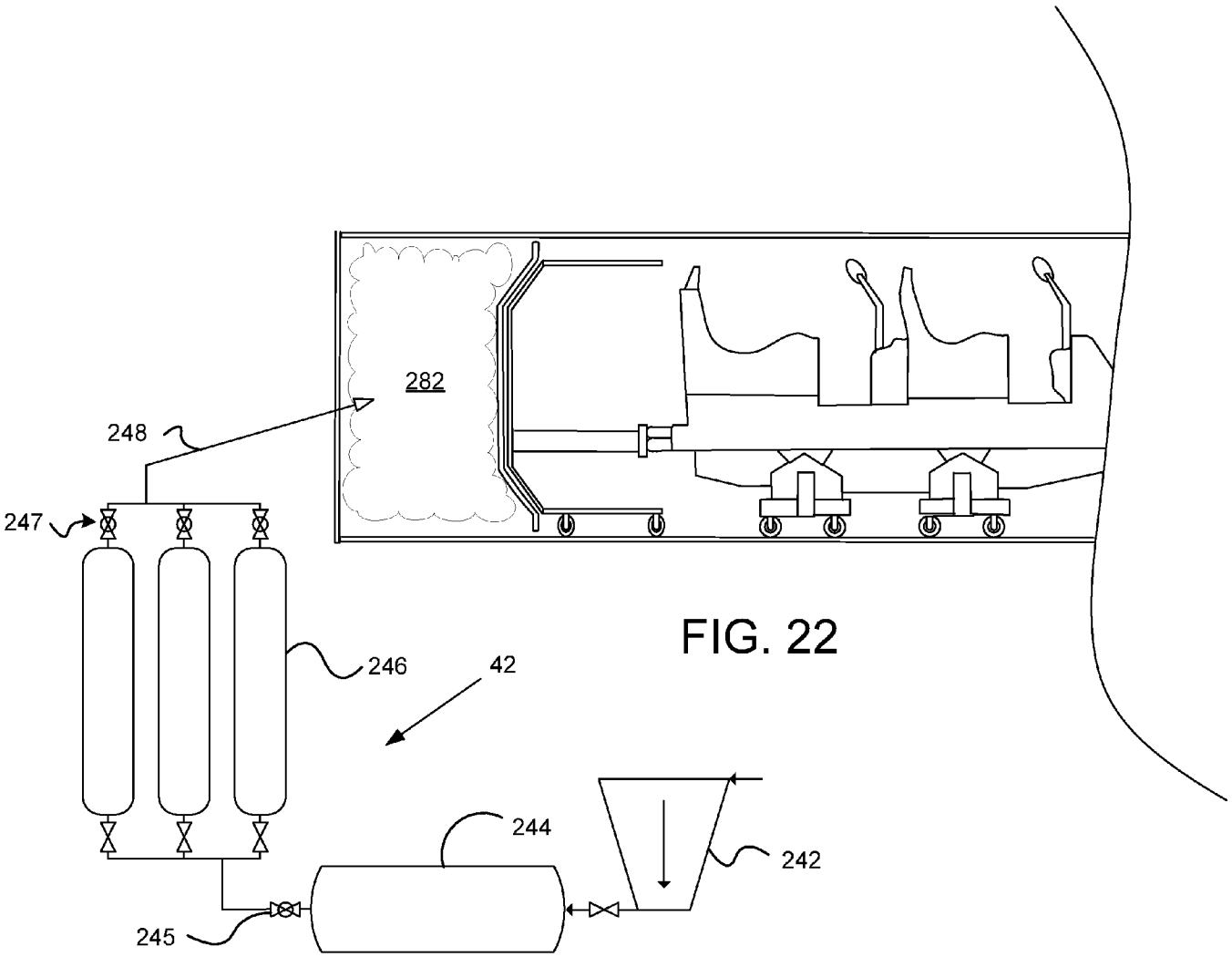
FIG. 22 is a schematic block diagram of a pneumatic propulsion mechanism according to one embodiment of the present disclosure.

FIG. 22 is a schematic block diagram of a pneumatic propulsion mechanism 342, according to one embodiment of the present disclosure. The pneumatic propulsion mechanism 342 provides sufficient power to accelerate the car 320 along the launch rails 344 to a certain velocity. During launching, the pneumatic propulsion mechanism 342 is activated to accelerate the carriage 346, which in turn accelerates the car 320 via engagement with the car, along the launch rails 344 to a desired launch velocity. Once the launch velocity is reached, the acceleration system 310 will then provide rapid braking of the carriage 346 via a deceleration system 338 as it approaches the second end 336 of the launch structure 340. Because the carriage 346 is rapidly decelerated and the car 320 is releasably coupled to the carriage 46, the momentum of the car 320 carries the car forward and out of the second end 336 of the launch structure 340 at a high rate of speed. It is understood that other types of interconnections 358 between the car 320 and the carriage 346 are possible, as described above.

The pneumatic propulsion mechanism 342, according to one embodiment, includes an air compressor 342 supplying pressurized air to an air tank 344. The air tank 344 can serve as bulk storage for compressed air over a wide range of pressures. The air tank 344 in turn feeds pressurized air through a control valve 345 to a plurality of shot tanks 346, which serve as the source of compressed air to the launch tube 370. Having multiple shot tanks can provide a degree of redundancy to the acceleration system to ensure that the car will always have sufficient velocity to exit the tube with the required/desired velocity, even if, for example, one shot tank 346 were to fail or one of the rapid-release shot valves 347 were to operate improperly. The shot valves 347 can be fast-opening control valves configured to quickly release the compressed air in the shot tanks into the first end portion 334 of the launch tube 370 through inlet pipe 348.

As depicted in FIG. 22, once the compressed air 382 is released into the variable volume extending from base of the launch tube 370 to the closed back end 355 of the carriage 346, the increased pressure acting on the back end 355 of the carriage 346 will immediately begin to push the cart along the rails 344. The carriage 346 and the car 320 can together weigh about 2,000 lbs or more when loaded with the passengers. However, because the back end 355 of the carriage 346 or the packing blanket 356 (or other type of sealing component) can have an effective surface area of about 7,000 square inches or more, the pneumatic-based acceleration system may only be required to provide the compressed air 382 at pressure ranging from about 2 to about 4 PSIG to accelerate the shot cart and car up the launch tube 370. In other implementations the pressure can be more or less then the range specified above, depending upon the configuration and dimensions of the launch tube 370 and carriage 346.

Accordingly, the pneumatic capacities and dynamic responses of the shot tanks 346, control valves 347 and inlet pipe 348 can be configured to continuously provide an amount of compressed air at a desired pressure to the base of the launch tube 370 that will maintain the compressed air 382 within the rapidly-expanding volume below the carriage 346 at a substantially constant pressure. If desired, bleed ports (not shown) can be incorporated into the walls of the launch tube 370 to release some of the pressure as the carriage 46 moves toward the second end portion 336 of the launch tube. In one aspect the compressed air 382 within the expandable volume can be maintained at sufficient pressure throughout the upward movement of the carriage 346 to accelerate both the carriage 346 and the car 320 at about 4 g's to a launch speed of approximately 120 miles per hour, prior to reaching the second end 36 of the launch tube 370. In other aspects the launch speed of the carriage 346 and car 320 can be more or less than 120 miles per hour.

In addition, after the carriage 346 has been stopped and the car 320 has been launched from the launch tube 3270, a pressure release valve (not shown) in fluid communication with the base of the launch tube can open to controllably vent the compressed air 382 located within the tube 370 and allow the carriage 346 to return to the first end portion 334 of the launch tube 370. In another embodiment, a pulley system or other retraction device may be used to pull the carriage 346 back to the first end 334 of the launch tube 370 in preparation for another launch.

In yet another embodiment, the ride acceleration system 310 can also be configured to be a deceleration system. In other words, a similar system may be configured at the end of the ride (or the passenger cars 320 may simply return to the launch tube 370) and the pressure release valves (not depicted) along the length of the tube 370 may be controllably opened to allow a cushioned deceleration of the passenger car 320 as the car engages the carriage 346 and expels the compressed air 382 as it moves in reverse along the launch tube 370 back towards the first end portion 34.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An amusement ride, comprising:

a capsule configured to contain and secure at least one passenger;

a launch system having an upper end at a first height above a reference surface, the launch system being configured to launch the capsule containing the passenger in an arc-shaped path extending to a second height greater than the first height; and a capture system having a receiving end at a third height less than the second height, the capture system being configured to flexibly capture the capsule;

wherein the capsule experiences untethered free motion while traveling the arc-shaped path from the upper end of the launch system to the receiving end of the capture system.

2. The amusement ride of claim 1, wherein a launch angle between a launch portion of the arc-shaped path and horizontal is greater than about eighty degrees.

3. The amusement ride of claim 1, wherein the second height is greater than about one and a half times the first height.

4. The amusement ride of claim 1, wherein the launch system is selected from the group consisting of a combustion-based launch system, a pneumatic-based launch system, a hydraulic-based launch system, and a magnetic propulsion-based launch system.

5. The amusement ride of claim 1, wherein the launch system comprises:

a launch tube having a longitudinal axis; and a shot cart translatable along the longitudinal axis of the launch tube for releasably supporting the capsule during launch.

6. The amusement ride of claim 5, wherein the launch tube comprises an open end and a closed end, the launch system further comprising a compressed air delivery system configured to pressurize a space within the launch tube between the shot cart and the closed end, wherein pressurized air within the space drives the shot cart and capsule along the longitudinal axis of the launch tube.

7. The amusement ride of claim 6, further comprising a braking mechanism configured to decelerate the shot cart to release the capsule from the shot cart.

8. The amusement ride of claim 1, wherein the capture system includes at least one of a web member made from a flexible material, a plurality of cable-based support systems mechanically coupled to a plurality of damper mechanisms, or a plurality of bendable support pylons.

9. The amusement ride of claim 8, wherein the capture system comprises the web member for capturing the capsule made from a stretchable material, the plurality of cable-based support systems for supporting the web member and being mechanically coupled to the plurality of spring/damper mechanisms, and the plurality of bendable support pylons for supporting the plurality of cable-based support systems.

10. A method of moving amusement ride passengers through an arc-shaped path above a reference surface with untethered free motion, the method comprising:

loading at least one passenger within a capsule, the capsule being configured to contain and secure the passenger while traveling along the arc-shaped path;

loading the capsule containing the passenger into a lower end of a launch system having an upper end at a first height above the reference surface;

launching the capsule containing the passenger into the arc-shaped path and towards a receiving end of a capture system, the arc-shaped path extending to a second height above the reference surface greater than the first height, the capsule experiencing untethered free motion while traveling the arc-shaped path from the upper end of the launch system towards the receiving end of the capture system; and capturing the capsule containing the passenger at the receiving end of the capture system.

11. The method of claim 10, further comprising launching the capsule at a launch angle greater than about eighty degrees, the launch angle being measured between a launch portion of the arc-shaped path and horizontal.

12. The method of claim 10, wherein the receiving end of the capture system is located at a third height above the reference surface, the third height being less than the second height.

13. The method of claim 10, further comprising:

removing the capsule containing the passenger from the receiving structure; and unloading the passenger from the capsule.

14. An amusement ride, comprising:

a launch structure comprising a rail pathway within a tube, the tube comprising a closed first end and an open second end;

a carriage comprising a component that pushes a passenger car along the rail pathway in the launch structure; and a pneumatic propulsion mechanism that pressurizes the tube between the first closed end of the tube and the carriage to propel the carriage and passenger car along the rail pathway.

15. The amusement ride of claim 14, wherein the passenger car is releasably coupled to the carriage, the amusement ride further comprising a braking system configured to decelerate the carriage to release the passenger car from the carriage.

16. The amusement ride of claim 14, wherein the rail pathway within the tube extends in a substantially horizontal direction, the pneumatic propulsion mechanism propelling the carriage and passenger car along the rail pathway in the substantially horizontal direction.

17. An amusement ride, comprising:

an object supporting a passenger;

a carriage releasably supporting the object;

a propulsion mechanism accelerating the carriage and the object releasably supported by the carriage up to a desired velocity;

a braking mechanism decelerating the carriage to release the object from the carriage at the desired velocity; and an elongate tube within which the object and carriage are accelerated, the elongate tube comprising a closed end and open end, wherein the propulsion mechanism comprises a pressurized air delivery system configured to pressurize a space within the elongate tube between the carriage and the closed end.

18. The amusement ride of claim 17, wherein the object is an untethered capsule, the propulsion mechanism accelerating the carriage and the object in a substantially upwardly direction, wherein the object is released from the carriage at the desired velocity in the substantially upwardly direction.

19. The amusement ride of claim 17, wherein the object is a rollercoaster car movably coupled to a rail, the propulsion mechanism accelerating the carriage and the rollercoaster car in a substantially horizontal direction, wherein the rollercoaster car is released from the carriage at the desired velocity in the substantially horizontal direction.

* * * * *